United States Patent [19]

Miyamoto

[11] Patent Number: 4,979,357

[45] Date of Patent: Dec. 25, 1990

[54] DETECTING APPARATUS FOR DETECTING DISCREPANCY IN NUMBER OF STACKED COINS PROVIDED IN COIN WRAPPING MACHINE

[75] Inventor: Katsuyuki Miyamoto, Urawa, Japan

[73] Assignee: Laurel Bank Machines Co., Ltd., Tokyo, Japan

[21] Appl. No.: 484,912

[22] Filed: Feb. 26, 1990

[30] Foreign Application Priority Data

Feb. 27, 1989 [JP] Japan ..... 1-43053
Feb. 19, 1990 [JP] Japan ..... 2-37781

[51] Int. Cl.[5] ..... B65B 57/10

[52] U.S. Cl. ..... 53/504; 53/212; 53/494; 53/532

[58] Field of Search ..... 53/504, 494, 495, 493, 53/77, 212, 211, 532, 254, 587, 54

[56] References Cited

U.S. PATENT DOCUMENTS 3,469,365 9/1969 Uchida et al. ..... 53/54
4,058,954 11/1977 Asami ..... 53/504 X
4,235,061 11/1980 Watanabe et al. ..... 53/54
4,249,363 2/1981 Miyazaki ..... 53/504 X

FOREIGN PATENT DOCUMENTS 1568065 5/1980 United Kingdom .

*Primary Examiner*—James F. Coan

*Attorney, Agent, or Firm*—Fleit, Jacobson, Cohn, Price, Holman & Stern

[57] ABSTRACT

A detecting apparatus for detecting discrepancy in number of stacked coins provided for a coin wrapping machine including wrapping rollers for winding a wrapping film having a larger width than the height of stacked coins around stacked coins of a predetermined number so that there remain crimp regions crimpable above and below the stacked coins and an upper crimp claw and a lower crimp claw movable in the vertical direction, the upper crimp claw and the lower crimp claw being for crimping the crimp regions of the wrapping film by being moved toward each other and holding the stacked coins therebetween, the detecting apparatus for detecting discrepancy in number of stacked coins further including an upper arm for supporting the upper crimp claw, a lower arm for supporting the lower crimp claw, a rack extending vertically and fixed to one of the upper arm and the lower arm, a pinion rotatably mounted on the other of the upper and lower arms and engageable with the rack, an absolute type rotary encoder connected to the pinion for outputting absolute position data in accordance with the position of rotation thereof, and a detector for detecting any discrepancy in the number of the stacked coins by calculating the sum of distances traveled by the upper and lower crimp claws based upon the absolute position data output from the rotary encoder. The thus constituted detecting apparatus can detect discrepancies in the number of the stacked coins with high accuracy.

21 Claims, 3 Drawing Sheets

DETECTING APPARATUS FOR DETECTING DISCREPANCY IN NUMBER OF STACKED COINS PROVIDED IN COIN WRAPPING MACHINE

BACKGROUND OF THE INVENTION

The present invention relates to a detecting apparatus provided in a coin wrapping machine for detecting discrepancies in the number of stacked coins, and, more particularly, to such a detecting apparatus capable of accurately detecting discrepancies in the number of stacked coins to be wrapped in a coin wrapping machine.

DESCRIPTION OF PRIOR ART

In a coin wrapping machine, the genuineness and denominations of coins deposited thereinto are discriminated and the number of coins having the denomination to be wrapped is counted. Then, every predetermined number of the coins of the denomination to be wrapped are fed to a coin stacking section where they are stacked in a roll-form and the predetermined number of the roll-like stacked coins are further fed to a coin wrapping section. In the coin wrapping section, the stacked coins are rotated, while being supported by a supporting bar and held between three wrapping rollers, whereby a wrapping film having a larger width than the height of the stacked coins is wound around the stacked coins in such a manner that there remain above and below the stacked coins crimp regions of the wrapping film which are to be crimped, and a pair of an upper crimp claw and a lower crimp claw spaced in the vertical direction move toward each other, thereby to crimp the crimp regions of the wrapping film above and below the stacked coins and produce a roll of the wrapped coins.

Therefore, although the predetermined number of stacked coins should be always fed from the coin stacking section to the coin wrapping section, the number of stacked coins fed to the coin wrapping section is sometimes less than the predetermined number, since some of the stacked coins sometimes drop out when the stacked coins are fed from the coin stacking section to the coin wrapping section, or the number of stacked coins fed to the coin wrapping section is sometimes more than the predetermined number, since some of the stacked coins are not fed to the coin wrapping section and remain in the coin stacking section for some reason, whereby the remaining coin or coins are fed to the coin wrapping section together with the coins stacked in the coin stacking section in the next coin wrapping operation cycle.

In these cases, there arises a discrepancy between the number of coins to be wrapped and the predetermined number. Thus, Japanese Patent Publication No. 60-37519 proposes a coin wrapping machine in which when the pair of the upper crimp claw and the lower crimp claw move toward each other for wrapping coins which have been stacked in the coin stacking section and transferred to the coin wrapping section and the upper crimp claw comes into contact with the upper face of the uppermost coin of the stacked coins, any discrepancy in the number of stacked coins is detected by detecting the position of the upper crimp claw and judging whether or not the thus detected position of the upper crimp claw agrees with a reference position thereof.

However, since an operation for crimping the wrapping film wound around the roll-like stacked coins fed to the coin wrapping section is not carried out by moving only the upper crimp claw but by moving the upper and lower claws toward each other and holding the upper face of the uppermost coin and the lower face of the lowermost coin of the stacked coins therebetween, in the case where the lower crimp claw is not positioned at a predetermined position when crimping the wrapping film, even if there is no discrepancy between the number of the stacked coins and the predetermined number, the position of the upper crimp claw inevitably differs from the reference position thereof when the upper crimp claw comes into contact with the upper face of the uppermost coin of the stacked coins. Further, since for some reason the lower crimp claw sometimes may not go up to the predetermined position, it is impossible by detecting only the position of the upper crimp claw to prevent erroneous detection of a discrepancy in the number of the stacked coins.

SUMMARY OF THE INVENTION

It is therefore an object of the present invention to provide a detecting apparatus for a coin wrapping machine capable of detecting discrepancies in the number of stacked coins without fail.

The above and other objects of the present invention can be accomplished by a detecting apparatus for detecting discrepancy in number of stacked coins provided in coin wrapping machine comprising wrapping roller means for winding a wrapping film having a larger width than the height of stacked coins around stacked coins of a predetermined number so that there remain crimp regions crimpable above and below the stacked coins and upper crimp claw means and lower crimp claw means movable in the vertical direction, said upper crimp claw means and said lower crimp claw means being for crimping said crimp regions of the wrapping film by being moved toward each other and holding said stacked coins therebetween, said detecting apparatus for detecting discrepancy in number of stacked coins comprising upper arm means for supporting said upper crimp claw means, lower arm means for supporting said lower crimp claw means, rack means extending vertically and fixed to one of said upper arm means and said lower arm means, pinion means rotatably mounted on the other of said upper arm means and said lower arm means and engageable with said rack means, absolute type rotary encoder means connected to said pinion means for outputting absolute position data in accordance with the position of rotation thereof, and detecting means for detecting any discrepancy in the number of the stacked coins by calculating the sum of the distances traveled by said upper crimp claw and said lower crimp claw based upon said absolute position data output from said rotary encoder means.

In a preferred aspect of the present invention, said detecting means comprises trigger signal output means for outputting trigger signals when said upper crimp claw means and said lower crimp claw means have been moved to crimp positions where they can hold the stacked coins therebetween, detected data memory means for taking in the absolute position data being output from said rotary encoder means, storing them and outputting them to comparing means when the trigger signal is output, reference data memory means for storing reference data and outputting them to said comparing means and the comparing means for discriminating any discrepancy in the number of the stacked coins by comparing the absolute position data output from said detected data memory means with said reference data output from said reference data memory means.

In a further preferred aspect of the present invention, said reference data memory means is constituted to produce reference data successively and renew them based upon the absolute position data input into the detected data memory means and stored therein.

In a further preferred aspect of the present invention, the detecting apparatus for detecting discrepancy in number of stacked coins further includes allowance value memory means for storing allowance values, said allowance values being adapted to be used so that when said comparing means compares the absolute position data with the reference data for discriminating any discrepancy in the number of the stacked coins and difference between the absolute position data and the reference data exceeds said allowance value, it judges that there is a discrepancy in the number of the stacked coins, and allowance value selection means for selecting from among the allowance values stored in said allowance value memory means an allowance value to be used for comparing the absolute position data with the reference data by the comparing means.

In a further preferred aspect of the present invention, said detecting means comprises trigger signal output means for outputting a first trigger signal when said upper crimp claw means and said lower crimp claw means are positioned at their retracted position where the upper crimp claw means is positioned at the uppermost position and the lower crimp claw means is positioned at the lowermost position and outputting a second trigger signal when said upper crimp claw means and said lower crimp claw means are positioned at the crimp position, detected data memory means for respectively taking in the absolute position data being output from said rotary encoder means when the first trigger signal is output and the second trigger signal is output, calculating the difference between the absolute position data, storing it and outputting it to comparing means, reference data memory means for storing reference data and outputting them to the comparing means and comparing means for discriminating any discrepancy in the number of the stacked coins by comparing the difference between the absolute position data output from said detected data memory means and said reference data output from said reference data memory means.

In a further preferred aspect of the present invention, the detecting apparatus for detecting discrepancy in number of stacked coins further includes correction means for correcting the absolute position data taken in by said detected data memory means when said first trigger signal is output and said second signal output.

In a further preferred aspect of the present invention, the detecting apparatus for detecting discrepancy in number of stacked coins further includes crimp claw malfunction discriminating means for outputting an abnormality signal when it judges that the difference between the absolute position data output from said rotary encoder means calculated by said detected data memory means is less than the sum of the distances traveled by the upper crimp claw means and the lower crimp claw means in the case where a predetermined number of coins of a denomination with greatest thickness are stacked.

The above and other objects and features of the present invention will become apparent from the following description made with reference to the accompanying drawings.

DESCRIPTION OF THE PREFERRED EMBODIMENTS

Figure 1:
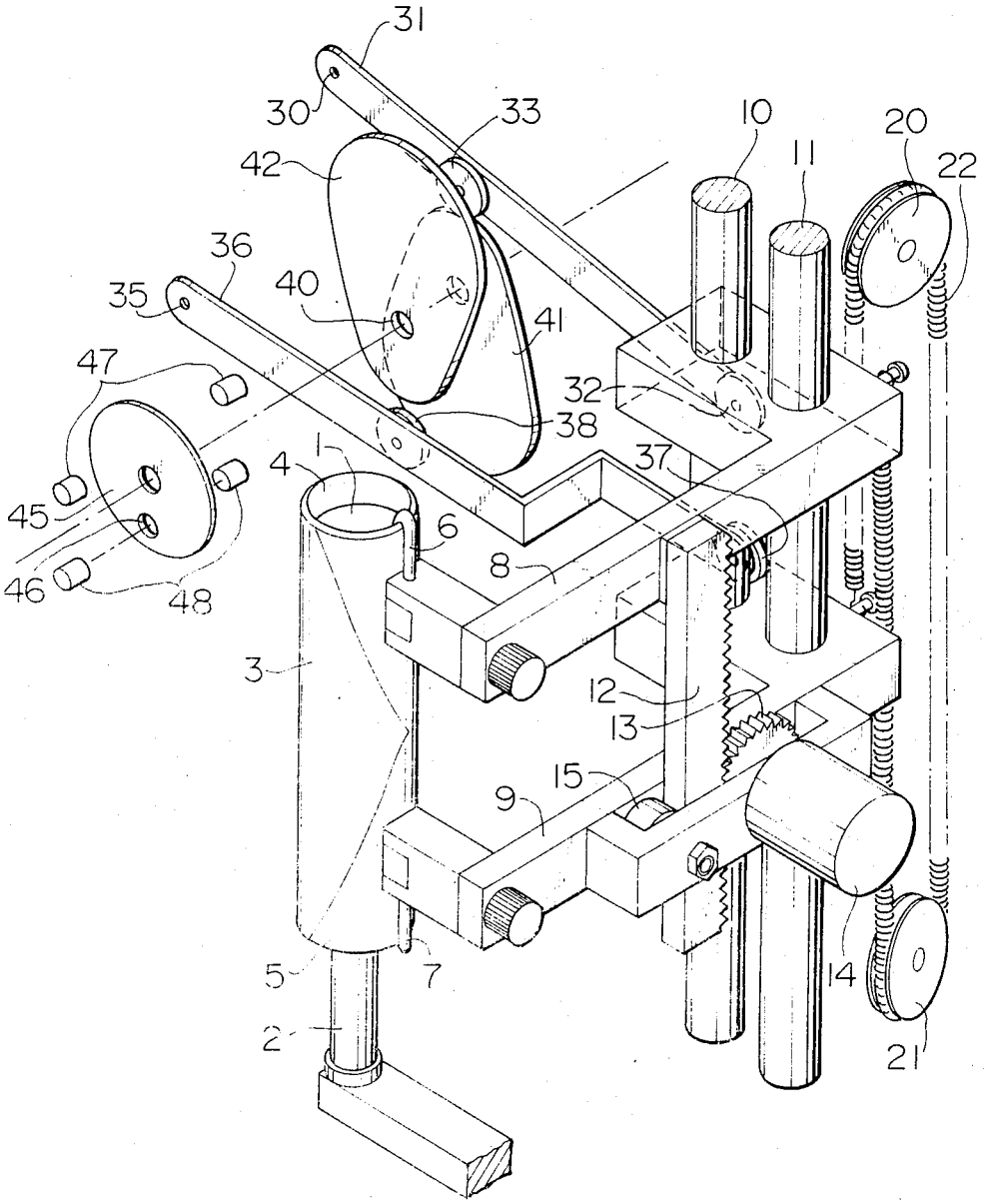
FIG. 1 is a schematic drawing showing a perspective view of a detecting apparatus for detecting discrepancy in number of stacked coins provided in a coin wrapping machine which is an embodiment of the present invention.

Referring to FIG. 1, deposited coins are discriminated as to whether or not they are genuine and their denomination agrees with a predetermined one and the number thereof is counted in a coin discriminating and counting section (not shown), whereby only genuine coins of the predetermined denomination are sorted and every predetermined number of them are fed to a coin stacking section where they are stacked in a roll-form. The thus obtained roll-like stacked coins 1 are transferred to a wrapping position in a coin wrapping section, while they are being held on a supporting bar 2. Afterward, they are rotated, while being held between three wrapping rollers (not shown) and a wrapping film 3 having a larger width than the height of the stacked coins 1 is fed by a wrapping film feed means (not shown) and is wound around the stacked coins 1 in such a manner that crimp regions 4, 5 of the wrapping film 3 remain above and below the stacked coins 1.

A coin wrapping machine comprises an upper crimp claw 6 and a lower crimp claw 7 for wrapping the stacked coins in a roll-form with the wrapping film 3 by crimping the crimp regions 4, 5 of the wrapping film 3 above and below the stacked coins 1. The upper crimp claw 6 is fixed to one end of an upper arm 8 and the lower crimp claw 7 is fixed to one end of a lower arm 9. Near their the other ends, the upper arm 6 and the lower arm 7 are respectively supported by guide rods 10, 11 so as to be able to move vertically, that is, approach and separate from each other.

A rack 12 extending vertically is fixed to the upper arm 8 to which the upper crimp claw 6 is fixed and a pinion 13 engageable with the rack 12 is rotatably mounted on the lower arm 9 to which the lower crimp claw 7 is fixed, whereby a rack and pinion mechanism is formed. An absolute type rotary encoder 14 is connected with the pinion 13. The reference numeral 15 designates a guide roller for guiding the rack 12, thereby to ensure engagement between the rack 12 and the pinion 13.

The upper arm 8 and the lower arm 9 are connected by a spring 22 engaged with pulleys 20, 21 and the upper arm 8 is biased downwardly and the lower arm 9 is biased upwardly by the spring 22.

A roller 32 abuts on the lower face of the upper arm 8 in the vicinity of the guide rods 10, 11, the roller 32 being secured to a tip end of an upper swing arm 31 swingable about a shaft 30 in the vertical plane, and a cam follower 33 is rotatably mounted on the upper swing arm 31 at substantially the central portion thereof between the shaft 30 and the roller 32. On the other hand, a roller 37 abuts on the upper face of the lower arm 9 in the vicinity of the guide rods 10, 11, the roller 37 being secured to a tip end of a lower swing arm 36 swingable about a shaft 35 in the vertical plane, and a cam follower 38 is rotatably mounted on the lower swing arm 36 at substantially the central portion thereof between the shaft 35 and the roller 37.

The cam follower 33 of the upper swing arm 31 abuts on the cam lobe of a first cam 41 rotatable about a cam shaft 40 and the cam follower 38 of the lower swing arm 36 abuts on the cam lobe of a second cam 42 rotatable about the cam shaft 40. The first cam 41 and the second cam 42 are connected with each other so as to be rotated together. The profiles of the first cam 41 and the second cam 42 are respectively determined so that each has a cam lobe furthest from the cam shaft 40 and a cam lobe closest to the cam shaft 40 at positions spaced by 180 degree, and that when the cam follower 33 of the upper swing arm 31 and the cam follower 38 of the lower swing arm 36 respectively abut on the cam lobes furthest from the cam shaft 40, the upper crimp claw 6 is positioned at its uppermost position and the lower crimp claw 7 is positioned at its lowermost position, in other words, they are positioned at their retracted positions, while when the cam follower 33 of the upper swing arm 31 and the cam follower 38 of the lower swing arm 36 respectively abut on the cam lobes closest to the cam shaft 40, the upper crimp claw 6 is positioned at its lowermost position and the lower crimp claw 7 is positioned at its uppermost position. The lowermost position of the upper crimp claw 6 and the uppermost position of the lower crimp claw 7 are set in such a manner that the former is lower than and the latter is higher than positions where the upper crimp claw 6 and the lower crimp claw 7 can hold a stack of coins consisting of a predetermined number of coins of a denomination with smallest thickness to be wrapped by the coin wrapping machine therebetween. More specifically, when the upper crimp claw 6 and the lower crimp claw 7 hold the stacked coins therebetween, in other words, when the upper crimp claw 6 and the lower crimp claw 7 have reached their crimp positions, in normal situations, the upper crimp claw 6 cannot be lowered any further and the lower crimp claw 7 cannot be raised any further. However, in the case where one of the upper crimp claw 6 and the lower crimp claw 7 has not moved to its predetermined position for some reason, the other is further moved until the upper crimp claw 6 and the lower crimp claw 7 can hold the stacked coins therebetween, whereby it is always possible to detect any discrepancy in the number of the stacked coins without fail. Accordingly, in normal situations, the upper crimp claw 6 abuts on the upper face of the uppermost coin of the stacked coins to be wrapped and the lower crimp claw 7 abuts on the lower face of the lowermost coin of the stacked coins to be wrapped, even before the cam follower 33 of the upper swing arm 31 and the cam follower 38 of the lower swing arm 36 respectively come into contact with the cam lobes closest to the cam shaft 40. As a result, the upper and lower crimp claws 6, 7 and the upper and lower arms 8, 9 do not move any more. Then, when the first cam 41 and the second cam 42 are further rotated, the roller 32 departs from the lower face of the upper arm 8, while the cam follower 33 of the upper swing arm 31 abuts on the cam lobe of the first cam 41. On the other hand, the cam follower 38 of the lower swing arm 36 departs from the cam lobe of the second cam 42, while the roller 37 abuts on the upper face of the lower arm 9. Thus, the engagement between the first cam 41 and the upper arm 8 via the upper swing arm 31 and the engagement between the second cam 42 and the lower arm 9 via the lower swing arm 36 are released.

As shown schematically in FIG. 1, a disc 45 formed with a light transmission hole 46 and rotatable together with the first cam 41 and the second cam 42 is provided coaxially with the cam shaft 40 and photosensors 47, 48, each consisting of a light emitting element and a light receiving element, are disposed to confront the disc 45. The photosensor 47 is disposed so that light emitted from its light emitting element can be received via the light transmission hole 46 by its light receiving element when the cam follower 33 of the upper swing arm 31 and the cam follower 38 of the lower swing arm 36 respectively abut on the cam lobes of the first and second cams 41, 42 furthest from the cam shaft 40 and the photosensor 48 is disposed so that light emitted from its light emitting element can be received via the light transmission hole 46 by its light receiving element when the cam follower 33 of the upper swing arm 31 abuts on the cam lobe of the first cam 41 furthest from the cam shaft 40. The two photosensors 47, 48 are disposed so as to be spaced from each other by 180 degree with respect to the rotating direction of the discs 45. Therefore, it can be detected by the photosensor 47 that the upper crimp claw 6 and the lower crimp claw 7 are positioned at their retracted positions. Moreover, when the can follower 33 of the upper swing arm 31 is on the cam lobe of the first cam 41 closest to the cam shaft 40, then since the upper crimp claw 6 is positioned so as to abut on the upper face of the uppermost coin of the stacked coins to be wrapped and the lower crimp claw 7 is positioned so as to abut on the lower face of the lowermost coin of the stacked coins to be wrapped, in other words, they are positioned at their crimp positions, it is possible to detect by the photosensor 48 that the upper crimp claw 6 and the lower crimp claw 7 are positioned at their crimp positions.

As described above, when the first cam 41 and the second cam 42 are rotated by one revolution for wrapping a roll of stacked coins, the upper crimp claw 6 and the lower crimp claw 7 are respectively moved from their retracted positions to their crimp positions and returned to their retracted positions and the upper arm 8 and the lower arm 9 are moved in the vertical direction in accordance with the movement of the upper crimp claw 6 and the lower crimp claw 7. As a result, the pinion 13 rotatably mounted on the lower arm 9 is rotated by the rack 12 fixed to the upper arm 8 by a distance corresponding to the sum of the travel distances of the upper crimp claw 6 and the lower crimp claw 7 in the vertical direction. Since the absolute type rotary encoder 14 can output coded absolute position data of a predetermined number of bits in accordance with the position of rotation, it is possible to detect the travel distances of the upper crimp claw 6 and the lower crimp claw 7 in the vertical direction base upon the absolute position data output from the rotary encoder 14. For instance, in the case where a pinion 13 of a diameter of 24 mm and a rotary encoder 14 of 8 bits are employed, it is possible to obtain the absolute position data with a resolution of 0.29 mm.

Figure 2:
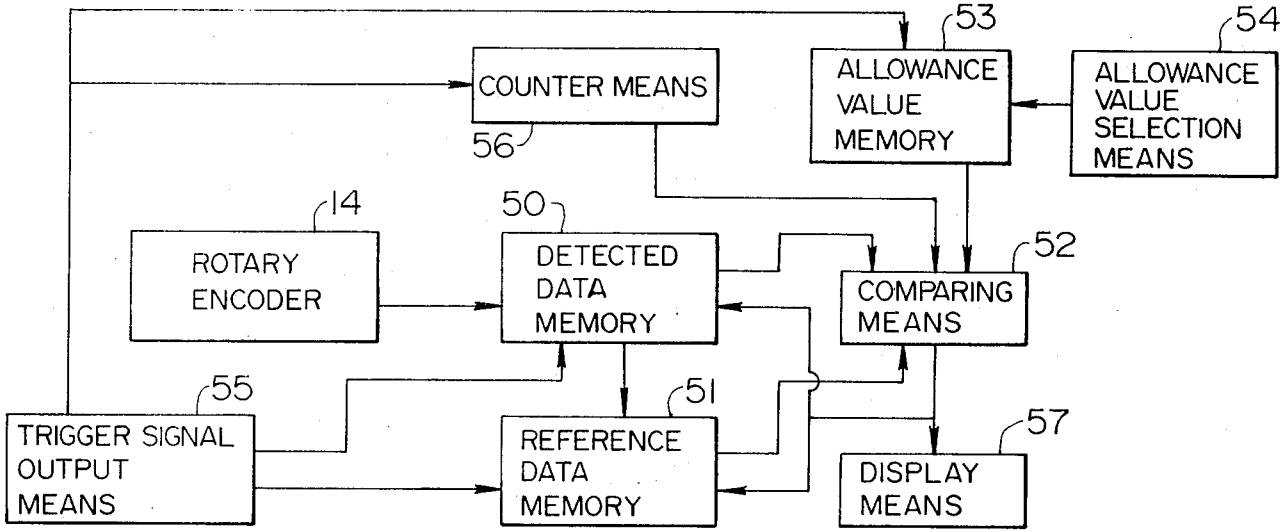
FIG. 2 is a block diagram showing a control system and a judgment system of a detecting apparatus for detecting discrepancy in number of stacked coins provided in a coin wrapping machine which is an embodiment of the present invention.

FIG. 2 is a block diagram showing a control system and a judgment system of the detecting apparatus for detecting discrepancy in number of stacked coins which is an embodiment of the present invention.

In FIG. 2, the control system and the judgment system of the detecting apparatus for detecting discrepancy in number of stacked coins comprise a detected data memory 50 for storing absolute position data output from the rotary encoder 14, a reference data memory 51 for storing reference data which are to be compared with the absolute position data stored in the detected data memory 50 for detecting discrepancy in number of the stacked coins, a comparing means 52 for calculating a difference between the absolute position data and the reference data and outputting a coincidence signal when the thus calculated difference is not more than an allowance (tolerance) value and a discrepancy signal when the difference is more than the allowance value, an allowance value memory 53 for storing allowance values based upon which whether or not there is a discrepancy in the number of the stacked coins is judged, an allowance value selecting means 54 for outputting a selection signal to the allowance value memory 53 based upon an instruction signal input by an operator and selecting from among the allowance values stored in the allowance value memory 53 an allowance value to be output to the comparing means 52, thereby to cause the allowance value memory 53 to output the thus selected allowance value to the comparing means 52, a trigger signal output means 55 for outputting a trigger signal to the detected data memory 50, the reference data memory 51, the allowance value memory 53 and a counter means 56, when the photosensor 48 detects that the upper crimp claw 6 and the lower crimp claw 7 have reached their crimp position, thereby to cause the detected data memory 50 to store the absolute data being output from the rotary encoder 14 and output the thus stored absolute position data to the comparing means 52, cause the reference data memory 51 to output the reference data to the comparing means 52 and cause the allowance value memory 53 to output the allowance value selected based upon the selection signal input from the allowance value selection means 54 to the comparing means 52 so that the comparing means 52 starts judgment as to whether there is a discrepancy in the number of the stacked coins, a counter means 56 for receiving a start signal from a wrapping operation start switch (not shown) and the trigger signal from the trigger signal output means 55, counting how many wrapping operations have been completed after the wrapping operation was started and outputting the thus counted count value to the comparing means 52, and a display means 57 for displaying whether or not the number of the stacked coins 1 to be wrapped coincides with a predetermined number based upon the coincidence signal or the discrepancy signal output from the comparing means 52.

In the thus constituted control system and judgment system of the detecting apparatus for detecting discrepancy in number of stacked coins which is an embodiment of the present invention, when the photosensor 48 detects that the upper crimp claw 6 and the lower crimp claw 7 have reached their crimp positions from their retracted positions and a detection signal is output from the photosensor 48 to the trigger signal output means 55, the trigger signal output means 55 outputs the trigger signal to the detected data memory 50, the reference data memory 51 and the allowance value memory 53 based upon the detection signal. The detected data memory 50 stores the absolute position data being output from the rotary encoder 14 and outputs the thus stored absolute position data to the comparing means 52 when it receives the trigger signal from the trigger signal output means 55. The reference data memory 51 outputs the reference data to the comparing means 52 when it receives the trigger signal from the trigger signal output means 55. Simultaneously, the allowance value memory 53 outputs the allowance value selected from among the allowance values stored therein based upon the selection signal input from the allowance value selection means 54 to the comparing means 52. The comparing means 52 calculates the difference between the absolute position data input from the detected data memory 50 and the reference data input from the reference data memory 51 and judges whether or not the absolute value of the thus calculated difference falls within the allowance value input from the allowance value memory 53. As a result, when the comparing means 52 judges that the absolute value of the difference between the absolute position data and the reference data is not more than the allowance value, it outputs the coincidence signal to the detected data memory 50, the reference data memory 51 and the display means 57 and causes the display means to display that the number of the stacked coins to be wrapped coincides with the predetermined number. On the other hand, when the comparing means 52 judges that the absolute value of the difference between the absolute position data and the reference data is more than the allowance value, it outputs the discrepancy signal to the detected data memory 50, the reference data memory 51 and the display means 57 and causes the display means 57 to display that the number of the stacked coins to be wrapped does not coincide with the predetermined number.

In this embodiment, the detecting apparatus for detecting discrepancy in number of stacked coins is constituted so that the reference data to be stored in the reference data memory 51 are produced based upon the absolute position data input from the rotary encoder 14 to the detected data memory and stored therein. This is because although the thickness of all coins of the same denomination is initially the same, individual coins become thinner with abrasion through use. In fact, therefore, the height of different roll-like stacks of coins of the same denomination is not necessarily constant, and, therefore, the accuracy of detection can be improved by producing the reference data based upon the absolute position data for coins actually deposited into the coin wrapping machine and comparing them with the absolute position data.

Accordingly, the detected data memory 50 is constituted by a memory capable of storing N pieces of absolute position data and the reference data memory 51 is also constituted by a memory capable of N pieces of reference data. The detected data memory 50 stores the absolute position data and outputs it to the reference data memory 51 when the absolute position data is input from the rotary encoder 14. Since the reference data are produced based upon the absolute position data in the above described manner, no reference data is stored in the reference data memory 51 when a first wrapping operation is carried out and, therefore, the discrepancy signal is necessarily output from the comparing means 52 if the comparing means 52 detects a discrepancy in the number of the stacked coins. Accordingly, to avoid such a situation, the counter means 56 judges how many wrapping operations have been completed based upon the start signal from the wrapping operation start switch (not shown) and the trigger signals from the trigger signal output means 55 and outputs the result of the judgment to the comparing means 52, thereby to prohibit the comparing means 52 from detecting discrepancy in number of the stacked coins in the first wrapping operation.

The reference data memory 51 produces the reference data based upon the absolute position data in the following manner and stores them therein and outputs them to the comparing means 52.

More specifically, in the first wrapping operation, since no reference data is stored in the reference data memory 51, the reference data memory 51 outputs zero as the reference data to the comparing means and, on the other hand, the detected data memory 50 stores the absolute position data $P_1$ input from the rotary encoder 14 as an acceptable absolute position data $M_1$ and outputs the absolute position data $M_1$ to the reference data memory 51 where the absolute position data $M_1$ is stored as the reference data R.

$$R=M_1$$

As described above, although the absolute position data $P_1$ is input to the comparing means 52, it does not detect discrepancy in number of the stacked coins.

In a second wrapping operation, the reference data memory 51 outputs the reference data R stored in the first wrapping operation. The comparing means 52 calculates the difference between the thus input reference data R and the absolute position data $P_2$ input from the detected data memory 50 and judges whether or not the absolute value thereof falls within an allowance value A.

As a result, in the case where the comparing means 52 judges that the absolute value of the difference between the reference data R and the absolute data $P_2$ is not more than the allowance value, it outputs the coincidence signal to the detected data memory 50, the reference data memory 51 and the display means 57 respectively. When the detected data memory 50 receives the coincidence signal from the comparing means 52, it stores the absolute position data $P_2$ as an acceptable absolute position data $M_2$ and outputs the absolute position data $M_2$ to the reference data memory 51. When the reference data memory 51 receives the coincidence signal from the comparing means 52, it produces the reference data R in accordance with the following formula and stores it in place of the reference data which has been stored therein.

$$R=(M_1+M_2+(M_1+M_2)/2)/3$$

On the contrary, in the case where the comparing means 52 judges that the absolute value of the difference between the reference data R and the absolute position data $P_2$ is more than the allowance value A, it outputs the discrepancy signal to the detected data memory 50, the reference data memory 51 and the display means 57 respectively. When the detected data memory 50 receives the discrepancy signal from the comparing means 52, it rejects the absolute position data $P_2$ input from the rotary encoder 14 as unacceptable absolute position data and, on the other hand, when the reference data memory 51 receives the discrepancy signal from the comparing means 52, it does not carry out the renewal operation of the reference data R.

Assuming that by the time an i-th wrapping operation has been completed, the comparing means 52 has detected a discrepancy in the number of the stacked coins j times and outputted the discrepancy signal j times, wherein j is zero or a positive integer and less than i and N is not more than the difference (i−j), the reference data R to be output from the reference data memory 51 to the comparing means 52 for i-th detection operation of discrepancy in number of the stacked coins is represented by the following formula.

$$R=(S_k+S_k/k)/(k+1) \quad (1)$$

wherein $k=i-j$, $$S_k=M_1+M_2+M_k$$

In this manner, the reference data memory 51 produces the reference data R based upon the absolute position data $P_1, P_2, \ldots P_i$ output from the rotary encoder 14 to the detected data memory 50, stores them therein and outputs them to the comparing means 52 where any discrepancy in the number of the stacked coins is detected by comparing the absolute value of the difference between the absolute position data and the reference data with the allowance value A.

After (i−j) becomes equal to N, the reference data memory 51 replaces Mn by $M_n$ by $M_{n+1}$(n=1, 2, 3 . . . N−1) every time it receives the coincidence signal from the comparing means 52 and renews and stores the reference data R in accordance with the formula (1) and outputs them to the comparing means 52 to detect any discrepancy in the number of the stacked coins.

In this embodiment, although it is impossible to detect discrepancies in the number of the stacked coins in the first wrapping operation, it is possible to detect any discrepancy in the number thereof by collecting the roll-like wrapped coins wrapped in the first wrapping operation and depositing them into the coin wrapping machine again.

According to the above described embodiment, since the sum of the travel distances of the upper crimp claw 6 and the lower crimp claw 7 from the their retracted positions to their crimp positions is detected by the rack and pinion mechanism comprising the rack 12 fixed to the upper arm 8 and the pinion 13 rotatably mounted on the lower arm 9 and the absolute type of rotary encoder 14 connected to the pinion 13, and the profiles of the first cam 41 and the second cam 42 are determined so that in the case where one of the upper crimp claw 6 and the lower crimp claw 7 is not moved to its predetermined position for some reason, the other crimp claw is further moved so as to be able to hold the stacked coins between the upper crimp claw 6 and the lower crimp claw 7, it is possible to accurately detect the sum of the distances traveled by the upper crimp claw 6 and the lower crimp claw 7, even in the case where one of the upper crimp claw 6 and the lower crimp claw 7 is not moved to its predetermined position for some reason, whereby it is possible to detect discrepancy in number of the stacked coins to be wrapped with high accuracy.

Figure 3:
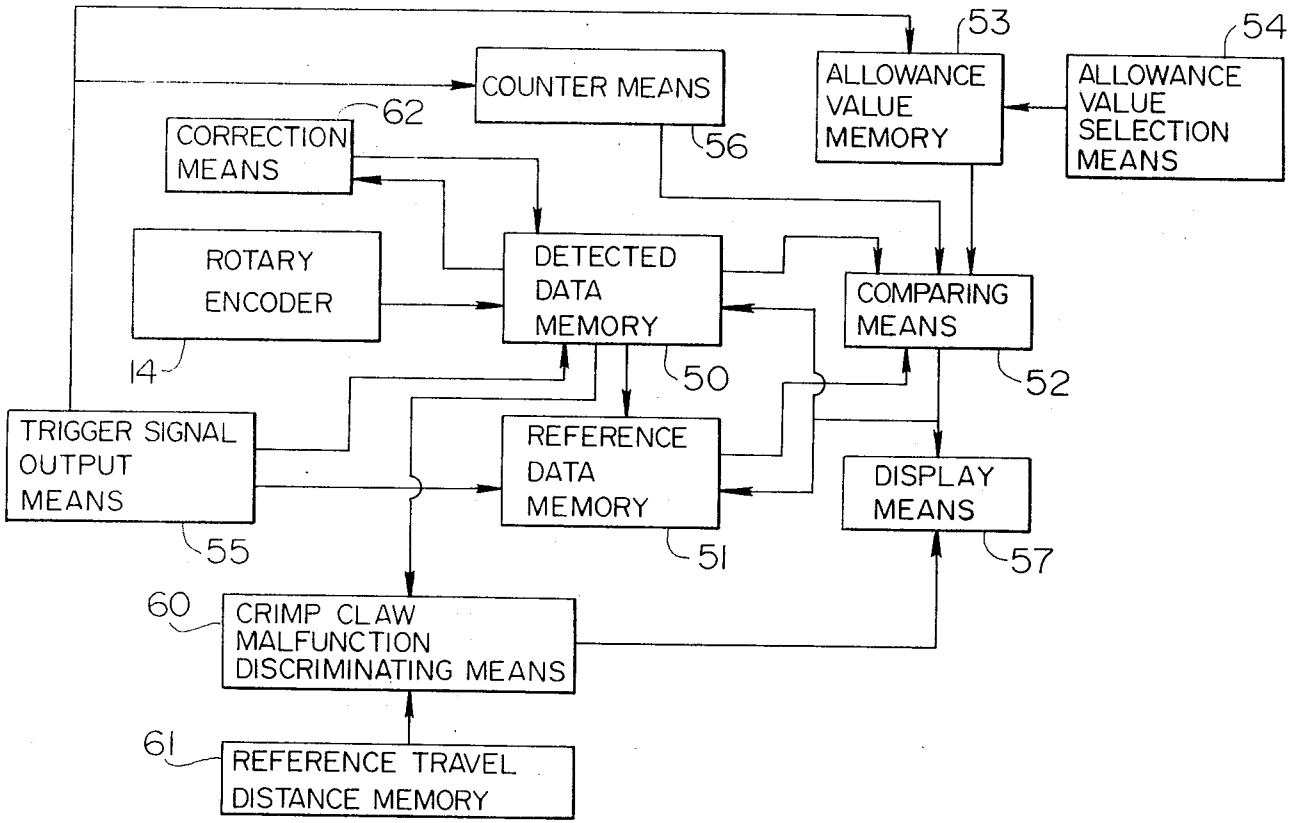
FIG. 3 is a block diagram showing a control system and a judgment system of a detecting apparatus for detecting discrepancy in number of stacked coins provided in a coin wrapping machine which is another embodiment of the present invention.

FIG. 3 is a block diagram showing a control system and a judgment system of the detecting apparatus for detecting discrepancy in number of stacked coins which is another embodiment of the present invention.

In FIG. 3, the trigger signal output means 55 is constituted so as to output a first trigger signal to the detected data memory 50, the reference data memory 51, the allowance value memory 53 and the counter means 56 when it judges based upon a detection signal from the photosensor 47 that the upper crimp claw 6 and the lower crimp claw 7 are positioned at their retracted positions, and output a second trigger signal to the detected data memory 50, the reference data memory 51, the allowance value memory 53 and the counter means 56 when it judges based upon a detection signal from the photosensor 48 that the upper crimp claw 6 and the lower crimp claw 7 are positioned at their crimp positions, thereby to cause the detected data memory 50 to respectively take in from the rotary encoder 14 the absolute position data when the upper crimp claw 6 and the lower crimp claw 7 are positioned at their retracted positions and those when the upper crimp claw 6 and the lower crimp claw 7 are positioned at their crimp positions and to calculate the difference therebetween. The comparing means 52 calculates the difference between the thus obtained difference between the two absolute position data and the reference data produced by the reference data memory 51 based upon the difference between the absolute position data and compares the so-calculated difference with the allowance value so that any discrepancy in the number of the stacked coins is detected. More specifically, in this embodiment, discrepancies in the number of the stacked coins is detected based upon the difference between the absolute position data detected in the retracted positions and that detected in the crimp positions, instead of on the basis of the absolute position data $P_i$ as in the previous embodiment, and the reference data are produced based upon the difference between the absolute position data detected in the retracted positions and that detected in the crimp positions. Since the reference data can be produced in a manner similar to that of the previous embodiment using instead of the absolute position data in the previous embodiment the calculated difference between the absolute position data detected in the retracted and that crimp positions, further details are omitted here.

The control system and the judgment system of the detecting apparatus for detecting discrepancy in number of stacked coins of the embodiment shown in FIG. 3 further include a crimp claw malfunction discriminating means 60 which compares the difference between the absolute position data detected in the retracted positions and that detected in the crimp positions output from the detected data memory 50 and a reference travel distance stored in advance in a reference travel distance memory 61 and output therefrom, calculates the difference therebetween, and outputs an abnormal signal to the display means 57 when the absolute value of the thus calculated difference is more than a predetermined value. This arrangement is used because there may be the case in which one or both of the upper crimp claw 6 and the lower crimp claw 7 are not moved in a predetermined manner for some reason so that the upper crimp claw 6 and the lower crimp claw 7 cannot hold the stacked coins therebetween. As there is some risk of erroneous detection if this should happen, the abnormal signal is displayed on the display means 57, thereby to let an operator know the occurrence of an abnormal situation. For this purpose, the reference travel distance stored in the reference travel distance memory 61 is determined so as to be not more than the sum of the travel distances of the upper crimp claw 6 and the lower crimp claw 7 in the case where the predetermined number of coins of a denomination with greatest thickness are stacked.

The control system and the judgment system of the detecting apparatus for detecting discrepancy in number of stacked coins of the embodiment shown in FIG. 3 further include a correction means 62 for correcting the absolute position data stored in the detected data memory 50. More specifically, in this embodiment, the sum of the travel distances of the upper crimp claw 6 and the lower crimp claw 7 are obtained by calculating the difference between the absolute position data when the upper crimp claw 6 and the lower crimp claw 7 are positioned at the retracted positions and that when the upper crimp claw 6 and the lower crimp claw 7 are positioned at the crimp positions and any discrepancy in the number of the stacked coins is detected based upon the difference between the thus calculated difference of the absolute position data and the reference data. However, in the case where the absolute type rotary encoder 14 of n bits is employed, $2^n$ pieces of absolute position data are output from the rotary encoder 14 and each of these absolute position data is indicated as one of the "0" to "$2^n-1$" so that "0" follows "$2^n-1$". Therefore, in the case where the indication increases as the upper crimp claw 6 and the lower crimp claw 7 are moved from their retracted positions to their crimp positions, once "0" is indicated when the upper crimp claw 6 and the lower crimp claw 7 are moved from their retracted positions to their crimp positions, it is impossible to obtain the correct sum of the travel distances of the upper crimp claw 6 and the lower crimp claw 7 by only subtracting the absolute position data when the upper crimp claw 6 and the lower crimp claw 7 are positioned at their retracted positions from that when they are positioned at their crimp positions. For avoiding such erroneous detection, in this embodiment, in the case where the absolute value of the difference between the absolute position data detected at the retracted positions and that at the crimp positions is not more than a predetermined value, the detected data memory 50 outputs a correction signal to the correction means 62 and when the correction means 62 receives the correction signal, it outputs a correction command signal to the detected data memory 50 so that the detected data memory 50 calculates the sum of the travel distances of the upper crimp claw 6 and the lower crimp claw 7 again by adding $2^n$ to the absolute position data when the upper crimp claw 6 and the lower crimp claw 7 are positioned at their crimp positions, whereby it is possible to obtain the correct sum of the travel distances of the upper crimp claw 6 and the lower crimp claw 7 and detect any discrepancy in the number of the stacked coins without fail.

According to this embodiment, in addition to the technical advantages of the previous embodiment, since the absolute position data when the upper crimp claw 6 and lower crimp claw 7 are positioned at their crimp positions is corrected by the correction means 62, if necessary, and any discrepancy in the number of the stacked coins is detected by subtracting the absolute position data when the upper crimp claw 6 and the lower crimp claw 7 are positioned at their retracted positions from that when they are positioned at their crimp positions to obtain the sum of the travel distances of the upper crimp claw 6 and the lower crimp claw 7 and judging whether or not the difference between the thus calculated sum of the travel distances of the upper crimp claw 6 and the lower crimp claw 7 and the reference data is not more than the allowance value, irrespective of the absolute position data indicated when the upper crimp claw 6 and the lower crimp claw 7 are positioned at their retracted positions or their crimp positions, it is possible to detect any discrepancy in the number of the stacked coins with high accuracy.

As described in detail with reference to the preferred embodiment, according to the present invention, it is possible to provide a detecting apparatus for detecting discrepancy in number of stacked coins with high accuracy in a coin wrapping machine.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, although the reference data memory 51 is constituted so as to store no reference data at the beginning and produce the reference data based upon the absolute position data output from the rotary encoder 14 and, therefore, it is impossible to detect any discrepancy in the number of the stacked coins in the first wrapping operation, it is possible to constitute the reference data memory 51 so as to store in advance only a reference data for detecting any discrepancy in the number of the stacked coins in the first wrapping operation and to produce the reference data used for detecting any discrepancy in the number of the stacked coins in and after the second wrapping operation or, alternatively, to store all required reference data in the reference data memory 51 without producing any reference data.

Further, in the above described embodiment, although the difference between the absolute position data and the reference data or the difference between the difference between the absolute position data detected at the crimp positions and the retracted positions and the reference data is calculated and any discrepancy in the number of the stacked coins is detected depending upon a judgment as to whether or not the thus calculated difference is not more than the allowance value, the discrepancy in the number of the stacked coins may be detected based upon the ratio between the difference and the allowance value rather upon the difference therebetween.

Furthermore, in the above described embodiment, although explanation is made in the case where the indication increases as the upper crimp claw 6 and the lower crimp claw 7 are moved from their retracted positions to their crimp positions, the indication may be set so that it decreases as the upper crimp claw 6 and the lower crimp claw 7 are moved from their retracted positions to their crimp positions and in such a case, if the indication is returned to zero when the upper crimp claw 6 and the lower crimp claw 7 are moved from their retracted positions to their crimp positions, the sum of the travel distances of the upper crimp claw 6 and the lower crimp claw 7 can be correctly calculated by correcting the absolute position data at the crimp positions so as to be smaller by $2^n$ or the absolute position data at the retracted positions so as to be larger by $2^n$ and subtracting the absolute position data at the crimp positions from that at the retracted positions.

Moreover, in the above described embodiment, although the rack 12 is secured to the upper arm 8 and the pinion 13 is secured to the lower arm 9, it is possible to fix the rack 12 to the lower arm 9 and rotatably mount the pinion 13 on the upper arm 8.

Further, in the present invention, the respective means need not necessarily be physical means and arrangements whereby the functions of the respective means are accomplished by software fall within the scope of the present invention. In addition, the functions of two or more means may be accomplished by a single physical means and the function of a single means may be accomplished by two or more physical means.

I claim:

1. A detecting apparatus for detecting discrepancy in number of stacked coins provided in a coin wrapping machine comprising wrapping roller means for winding a wrapping film having a larger width than a height of stacked coins around stacked coins of a predetermined number so that there remain crimp regions crimpable above and below the stacked coins and upper crimp claw means and lower crimp claw means movable in the vertical direction, said upper crimp claw means and said lower crimp claw means being for crimping said crimp regions of the wrapping film by being moved toward each other and holding said stacked coins therebetween, said detecting apparatus for detecting discrepancy in number of stacked coins comprising upper arm means for supporting said upper crimp claw means, lower arm means for supporting said lower crimp claw means, rack means extending vertically and fixed to one of said upper arm means and said lower arm means, pinion means rotatably mounted on the other of said upper arm means and said lower arm means and engageable with said rack means, absolute type rotary encoder means connected to said pinion means for outputting absolute position data in accordance with a position of rotation thereof, and detecting means for detecting any discrepancy in the number of the stacked coins by calculating a sum of distances traveled by said upper crimp claw and said lower crimp claw based upon said absolute position data output from said rotary encoder means.

2. A detecting apparatus for detecting discrepancy in number of stacked coins in accordance with claim 1 wherein said detecting means comprises trigger signal output means for outputting trigger signals when said upper crimp claw means and said lower crimp claw means have been moved to crimp positions where they can hold the stacked coins therebetween, detected data memory means for taking in the absolute position data being output from said rotary encoder means, storing them and outputting them to comparing means when the trigger signal is output, reference data memory means for storing reference data and outputting them to said comparing means and the comparing means for discriminating any discrepancy in the number of the stacked coins by comparing the absolute position data output from said detected data memory means with said reference data output from said reference data memory means.

3. A detecting means for detecting discrepancy in number of stacked coins in accordance with claim 2 wherein said reference data memory means is constituted to produce reference data successively and renew them based upon the absolute position data input into the detected data memory means and stored therein.

4. A detecting apparatus for detecting discrepancy in number of stacked coins in accordance with claim 2 which further includes allowance value memory means for storing allowance values, said allowance values being adapted to be used so that when said comparing means compares the absolute position data with the reference data for discriminating any discrepancy in the number of the stacked coins and a difference between the absolute position data and the reference data exceeds said allowance value, it judges that there is a discrepancy in the number of the stacked coins, and allowance value selection means for selecting from among the allowance values stored in said allowance value memory means an allowance value to be used for comparing the absolute position data with the reference data by the comparing means.

5. A detecting apparatus for detecting discrepancy in number of stacked coins in accordance with claim 3 which further includes allowance value memory means for storing allowance values, said allowance values being adapted to be used so that when said comparing means compares the absolute position data with the reference data for discriminating any discrepancy in the number of the stacked coins and a difference between the absolute position data and the reference data exceeds said allowance value, it judges that there is a discrepancy in the number of the stacked coins, and allowance value selection means for selecting from among the allowance values stored in said allowance value memory means an allowance value to be used for comparing the absolute position data with the reference data by the comparing means.

6. A detecting apparatus for detecting discrepancy in number of stacked coins in accordance with claim 1 wherein said detecting means comprises trigger signal output means for outputting a first trigger signal when said upper crimp claw means and said lower crimp claw means are positioned at their retracted position where the upper crimp claw means is positioned at the uppermost position and the lower crimp claw means is positioned at the lowermost position and outputting a second trigger signal when said upper crimp claw means and said lower crimp claw means are positioned at the crimp position, detected data memory means for respectively taking in the absolute position data being output from said rotary encoder means when the first trigger signal is output and the second trigger signal is output, calculating a difference between the absolute position data, storing it and outputting it to comparing means, reference data memory means for storing reference data and outputting them to the comparing means and comparing means for discriminating any discrepancy in the number of the stacked coins by comparing the difference between the absolute position data output from said detected data memory means and said reference data output from said reference data memory means.

7. A detecting means for detecting discrepancy in number of stacked coins in accordance with claim 6 wherein said reference data memory means is constituted to produce reference data successively and renew them based upon the absolute position data input into the detected data memory means and stored therein.

8. A detecting apparatus for detecting discrepancy in number of stacked coins in accordance with claim 6 which further includes allowance value memory means for storing allowance values, said allowance values being adapted to be used so that when said comparing means compares the absolute position data with the reference data for discriminating any discrepancy in the number of the stacked coins and a difference between the absolute position data and the reference data exceeds said allowance value, it judges that there is a discrepancy in the number of the stacked coins, and allowance value selection means for selecting from among the allowance values stored in said allowance value memory means an allowance value to be used for comparing the absolute position data with the reference data by the comparing means.

9. A detecting apparatus for detecting discrepancy in number of stacked coins in accordance with claim 7 which further includes allowance value memory means for storing allowance values, said allowance values being adapted to be used so that when said comparing means compares the absolute position data with the reference data for discriminating any discrepancy in the number of the stacked coins and a difference between the absolute position data and the reference data exceeds said allowance value, it judges that there is a discrepancy in the number of the stacked coins, and allowance value selection means for selecting from among the allowance values stored in said allowance value memory means an allowance value to be used for comparing the absolute position data with the reference data by the comparing means.

10. A detecting apparatus for detecting discrepancy in number of stacked coins in accordance with claim 6 which further includes correction means for correcting the absolute position data taken in by said detected data memory means when said first trigger signal is output and said second signal output.

11. A detecting apparatus for detecting discrepancy in number of stacked coins in accordance with claim 7 which further includes correction means for correcting the absolute position data taken in by said detected data memory means when said first trigger signal is output and said second signal output.

12. A detecting apparatus for detecting discrepancy in number of stacked coins in accordance with claim 8 which further includes correction means for correcting the absolute position data taken in by said detected data memory means when said first trigger signal is output and said second signal output.

13. A detecting apparatus for detecting discrepancy in number of stacked coins in accordance with claim 9 which further includes correction means for correcting the absolute position data taken in by said detected data memory means when said first trigger signal is output and said second signal output.

14. A detecting apparatus for detecting discrepancy in number of stacked coins in accordance with claim 6 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

15. A detecting apparatus for detecting discrepancy in number of stacked coins in accordance with claim 7 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

16. A detecting apparatus for detecting discrepancy in number of stacked coins in accordance with claim 8 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

17. A detecting apparatus for detecting discrepancy in number of stacked coins in accordance with claim 9 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

18. A detecting apparatus for detecting discrepancy in number of stacked coins in accordance with claim 10 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

19. A detecting apparatus for detecting discrepancy in number of stacked coins in accordance with claim 11 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

20. A detecting apparatus for detecting discrepancy in number of stacked coins in accordance with claim 12 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

21. A detecting apparatus for detecting discrepancy in number of stacked coins in accordance with claim 13 which further includes crimp claw malfunction discriminating means for outputting an abnormality signal when it judges that the difference between the absolute position data output from said rotary encoder means calculated by said detected data memory means is less than a sum of distances traveled by the upper crimp claw means and the lower crimp claw means in the case where a predetermined number of coins of a denomination with greatest thickness are stacked.

* * * * *